US005208918A

United States Patent [19]

Royal

[11] Patent Number: 5,208,918

[45] Date of Patent: May 11, 1993

[54] GARMENT, PARTICULARLY FOR RESTRICTING WEARER'S UNDRESSING

[76] Inventor: Pearl Royal, 25-13 Newkirk Ave., 1/F, Brooklyn, N.Y. 11226

[21] Appl. No.: 899,486

[22] Filed: Jun. 16, 1992

[51] Int. Cl.[5] ..... A41D 13/00

[52] U.S. Cl. ..... 2/114; 2/69; 2/DIG. 7

[58] Field of Search ..... 2/46, 69, 69.5, 79, 2/78 A, 78 B, 75, 80, 114, 227, DIG. 7

[56] References Cited

U.S. PATENT DOCUMENTS

| | | | |
|---|---|---|---|
| 762,363 | 6/1904 | Talcott | 2/79 |
| 818,351 | 4/1906 | Clark | 2/114 |
| 1,489,046 | 4/1924 | Thompson | 2/DIG. 7 X |
| 2,008,152 | 7/1935 | Nier | 2/79 |
| 2,374,643 | 5/1945 | Boeltcher | 2/DIG. 7 X |
| 2,588,542 | 3/1952 | Kunz | 2/80 |
| 3,230,546 | 1/1966 | Sabee | 2/114 |
| 3,956,774 | 5/1976 | Spaulding | 2/79 |
| 4,258,440 | 3/1981 | McGowan | 2/DIG. 7 X |
| 4,382,303 | 5/1983 | Lunt | 2/114 |
| 4,612,673 | 9/1986 | Underhill | 2/DIG. 7 X |
| 4,644,589 | 2/1987 | Pettis | 2/DIG. 7 X |
| 4,737,995 | 4/1988 | Wiley | 2/DIG. 7 X |
| 4,914,756 | 4/1990 | Grassick | 2/227 |
| 5,048,122 | 9/1991 | Prieur | 2/DIG. 7 X |
| 5,062,159 | 11/1991 | Jakub | 2/DIG. 7 X |

*Primary Examiner*—Clifford D. Crowder
*Assistant Examiner*—Jeanette E. Chapman
*Attorney, Agent, or Firm*—Michael J. Striker

[57] ABSTRACT

A garment in particular for restraining an unauthorized wearer's undressing, with a front part, a rear part connected with the front part, the front and rear part each having a torso-covering portion, a pelvis-covering portion, and a leg-covering portion including two individual leg-covering sections. The front part is formed without slots to be opened for undressing, the rear part having a slot extending substantially over the torso-covering portion of the rear part. The leg-covering portion has a slot extending over both the leg-covering sections between the front part and the rear part. The slot extends substantially over the torso-covering portion of the rear part and the slot extends over the leg-covering sections between the front part and the rear part not communicating with one another so that an unslotted are remains in the rear part between the slots, so that simultaneously the garment has the unslotted front part and also the unslotted area of the rear part and thereby the front part without slots and the unslotted area of the rear part restrain an unauthorized wearer's undressing, and fastening means for closing and opening the slots.

3 Claims, 2 Drawing Sheets

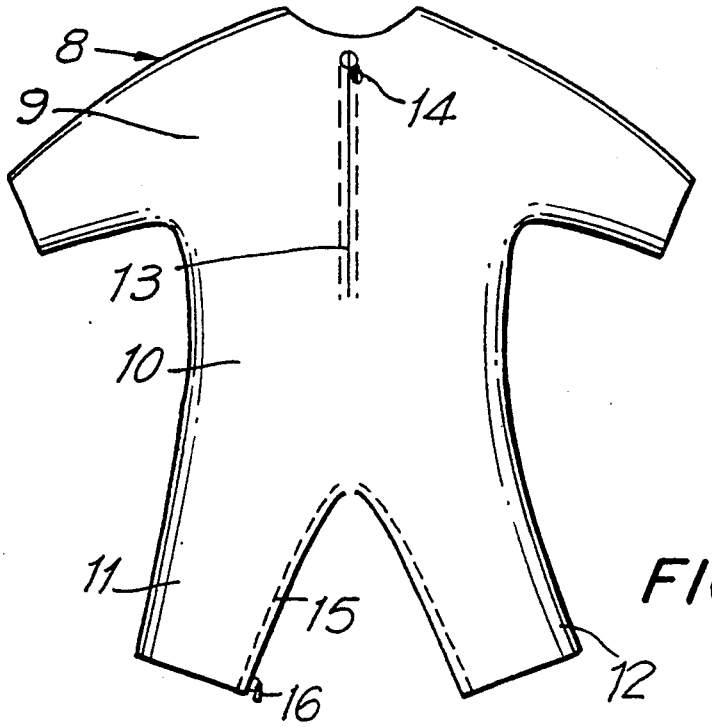
FIG. 2
FIG. 3
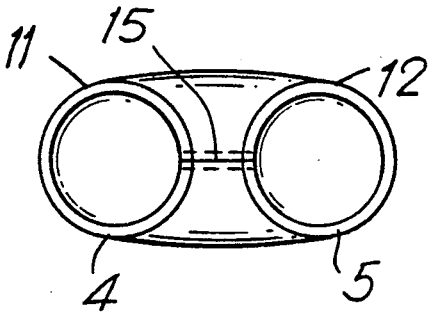
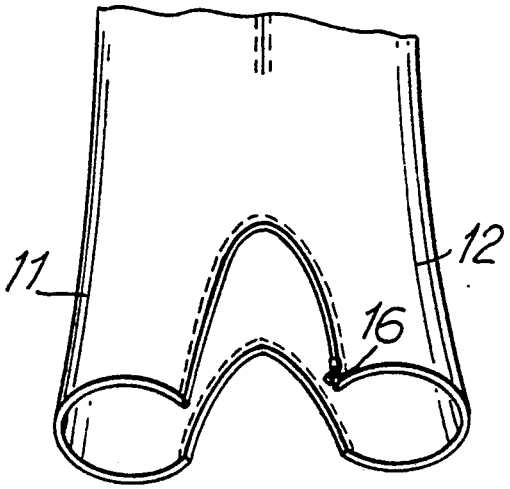
FIG. 4

GARMENT, PARTICULARLY FOR RESTRICTING WEARER'S UNDRESSING

BACKGROUND OF THE INVENTION

The present invention relates generally to a garment, and more particularly to such a garment where it is desired to restrict the wearer's undressing.

Such garments are recommended in hospitals, nursing homes, mental institutions, etc. Garments of this type must satisfy mutually contradictory requirements. More particularly, the garment must be designed so that it cannot be easily opened by a wearer to permit its unauthorized undressing. On the other hand, the garment must be easily opened by personnel to undress the wearer completely or to open a part of the garment for using a bathroom.

It is known to provide a garment for restraining purposes. Such garments usually are formed as gowns which are downwardly opened and have no separate leg covering pants-like portions. Restraining gowns have their own disadvantages, for example in the fact that they are open from below and expose lower parts of the wearer's body to ambient temperature.

Other garments are known in which the leg covering portions are provided and can be opened. Some of such garments are disclosed for example in U.S. Pat. Nos. 2,528,677, 2,654,893, 2,689,958, 2,915,758. However, these garments are not suitable for restraining special patients and also they are not simple and easy to be opened by personnel for undressing or going to the bathroom.

U.S. Pat. No. 2,588,542 teaches a garment which has a completely unslotted front part. As for the rear part it is completely slotted.

U.S. Pat. No. 2,915,758 teaches a garment with a front part which is slotted, and also teaches a rear part which is completely unslotted.

These garments are not suitable for restraining of special patients.

SUMMARY OF THE INVENTION

Accordingly, it is an object of the present invention to provide a garment for restraining a wearer's undressing, which avoids the disadvantages of the prior art.

More particularly, it is an object of the present invention to provide a garment in particular for restraining wearer's undressing, which reliably prevents a wearer from unauthorized opening of the garment and undressing, and at the same time makes easy and simple for personnel to open the garment for complete undressing or for partial undressing.

In keeping with these objects and with others which will become apparent hereinafter, one feature of the present invention resides, briefly stated, in a garment comprising a front part, a rear part connected with said front part, said front and rear part each having a torso-covering portion, a pelvis-covering portion, and a leg-covering portion including two individual leg-covering sections, said front part being formed without slots to be opened for undressing, said rear part having a slot extending substantially over said torso-covering portion of said rear part, said leg-covering portion having a slot extending over both said leg-covering sections between said front part and said rear part, said slot extending substantially over said torso-covering portion of said rear part and said slot extending over said leg-covering sections between said front part and said rear part not communicating with one another so that an unslotted are remains in said rear part between said slots, so that simultaneously the garment has said unslotted front part and also said unslotted area of said rear part and thereby said front part without slots and said unslotted area of said rear part restrain an unauthorized wearer's undressing; and fastening means for closing and opening said slots.

The garment of the invention has a front part and a rear part, the front part is completely unslotted, while the rear part is partially unslotted (has an unslotted area) so as to restrain an unauthorized wearer's undressing. The object of the present invention is to prevent unauthorized undressing by the wearer of the garment for example for hospitals, nursing homes, mental institutions.

In order to achieve these objects, the garment in accordance with the present invention is designed in a very special manner. The front part of the garment is an area which can be easily reached by a wearer. Taking this into consideration, the front part of the inventive garment is completely unslotted. The rear part of the garment is an area which is more difficult to reach by the wearer and for this reason the rear part of the garment was designed so as to be only partially unslotted. Thus, it is very important which part of the garment is completely unslotted, and which part of the garment is partially unslotted. It is the front part of inventive garment which is completely unslotted, and it is the rear part of the garment which is only partially unslotted. The remaining slotted area of the rear part permits personnel to undress the wearer.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a rear view of the inventive garment of FIG. 1 in accordance with one embodiment of the invention;

FIG. 3 is a view from below of the inventive garment of FIGS. 1 and 2; and FIG. 4 is a perspective view illustrating a partial opening of the inventive garment of FIGS. 1–3.

DESCRIPTION OF THE PREFERRED EMBODIMENTS

Figure 1:
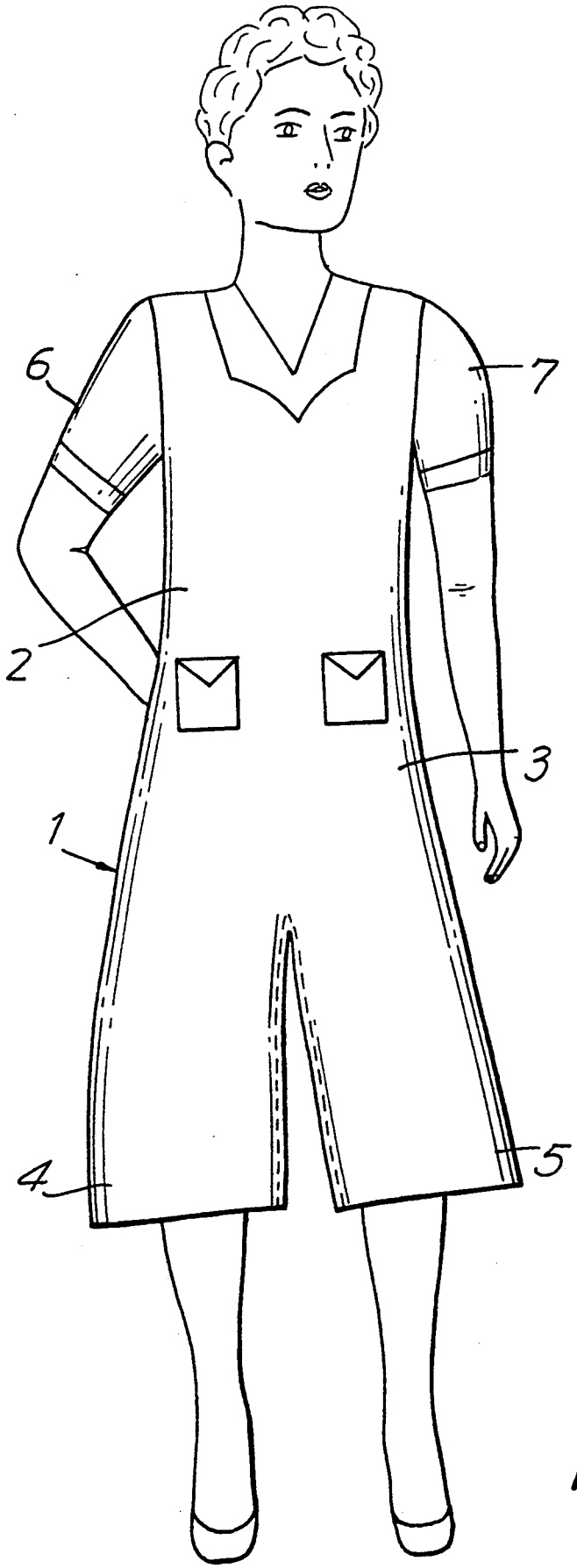
FIG. 1 is a front view of a garment for restraining wearer's undressing in accordance with the present invention.

A garment for restraining a wearer's undressing has a front part which is identified as a whole with reference numeral 1 in FIG. 1. The front part has a torso-covering portion 2, a pelvis-covering portion 3, and a legs-covering portion including two individual leg covering sections 4 and 5. The front part of the garment can be formed as a one-piece integral panel or composed of several parts connected with one another. However, the front part as a whole does not have any slots and respective fastening means for opening the garment at the front side for the purpose of undressing. The front part 1 can also be provided with individual arm0 covering sleeve portions 6 and 7.

The garment further has a rear part identified as a whole with reference numeral 8 and also having a torso-covering portion 9, a pelvis-covering portion 10, and a legs-covering portion including two individual leg-covering sections 11 and 12. The rear part 8 in FIG. 2 can be formed also as a single panel or composed of several parts connected with one another. The rear part 8 can be connected with the front part 1 by sewing seams, for example along the contours of these parts shown in FIGS. 1 and 2.

As can be seen from FIG. 2, the rear part is partially slotted and has a slot 13 extending substantially only over its torso-covering portion 9 from its upper edge downwardly. Fastening means, such as for example a sliding zipper, snap-fasteners, or roughened Velcro-type fasteners can be provided near the slot to permits its opening and closing. The zipper slider is identified with reference numeral 14.

The garment in accordance with the present invention also has a continuous slot extending over the leg-covering portions 4, 11 and 5, 12 substantially between the front part 1 and the rear part 8. In other words, the leg-covering portion 4 is not connected with the leg-covering portion 11 permanently, and the leg-covering portion 5 is not connected with the leg-covering portion 12 permanently. Instead, a continuous slot 15 is retained between them. Fastening means similar to the above-mentioned fastening means for the slot 13 are provided in the slot 15 for opening and closing the slot. A zipper slider is identified as an example with reference numeral 16.

In a garment designed in accordance with the present invention as shown in FIGS. 1–3, when a wearer has to go to a bathroom, the slot 15 is opened over its whole length for example by personnel to expose the lower part of the wearer's body.

It will be understood that each of the elements described above, or two or more together, may also find a useful application in other types of constructions differing from the types described above.

While the invention has been illustrated and described as embodied in a garment in particular for restraining wearer's undressing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A garment, in particular for restraining an unauthorized wearer's undressing, comprising a front part, a rear part connected with said front part, said front and rear part each having a torso-covering portion, a pelvis-covering portion, and a leg-covering portion including two individual leg-covering sections, said front part being formed without slots to be opened for undressing, said rear part having a slot which extends exclusively over said torso-covering portion and does not extend over said pelvis-covering portion of said rear part, said leg-covering portion having a slot extending over both said leg-covering sections between said front part and said rear part, said slot extending exclusively over said torso-covering portion of said rear part and said slot extending over said leg-covering sections between said front part and said rear part not communicating with one another so that an unslotted area remains in said rear part between said slots, so that simultaneously the garment has said unslotted front part and also said unslotted area of said rear part and thereby said front part without slots and said unslotted area of said rear part restrain an unauthorized wearer's undressing; and fastening means for closing and opening said slots.

2. A garment as defined in claim 1, wherein said slot in said legs-covering portion extend from a lower edge of each of said leg-covering sections to a point of intersection of said leg-covering sections and is formed as an uninterrupted slot.

3. A garment as defined in claim 1, wherein said slots are independent from one another, said fastening means includes first fastening means provided in one of said slots and second fastening means provided in another of said slots and operating independently of one another.

* * * * *